United States Patent [19]

Barnes, Jr.

[11] 4,010,584

[45] Mar. 8, 1977

[54] MOBILE HOME FOUNDATION

[75] Inventor: Bennett H. Barnes, Jr., Charlottesville, Va.

[73] Assignee: Barnes Lumber Corporation, Charlottesville, Va.

[22] Filed: May 21, 1976

[21] Appl. No.: 688,819

[52] U.S. Cl. ..... 52/299; 52/DIG. 3

[51] Int. Cl.[2] ..... E02D 27/32; E04C 1/32

[58] Field of Search ..... 52/169, 299, 292, DIG. 3

[56] References Cited

UNITED STATES PATENTS

| | | | |
|---|---|---|---|
| 1,780,013 | 10/1930 | Friedman | 52/292 |
| 2,287,229 | 6/1942 | Carpenter | 52/299 |
| 2,990,588 | 7/1961 | McKinley | 52/292 |
| 3,921,356 | 11/1975 | Hughes | 52/299 |

*Primary Examiner*—John E. Murtagh

*Attorney, Agent, or Firm*—Sughrue, Rothwell, Mion, Zinn & Macpeak

[57] ABSTRACT

An all wood foundation for mobile homes is provided upon which the mobile home can rest in a semipermanent installation. A plurality of composite wood beams of pressure treated lumber are mounted directly on a gravel support bed beneath the mobile home transversely of the length thereof with the longitudinal I-beams of the mobile home resting on the beams. A top plate of the beam is extended at either side to the edges of the mobile home for supporting a decorative wooden skirt which extends from the ground to the base of the mobile home.

5 Claims, 3 Drawing Figures

FIG. 1
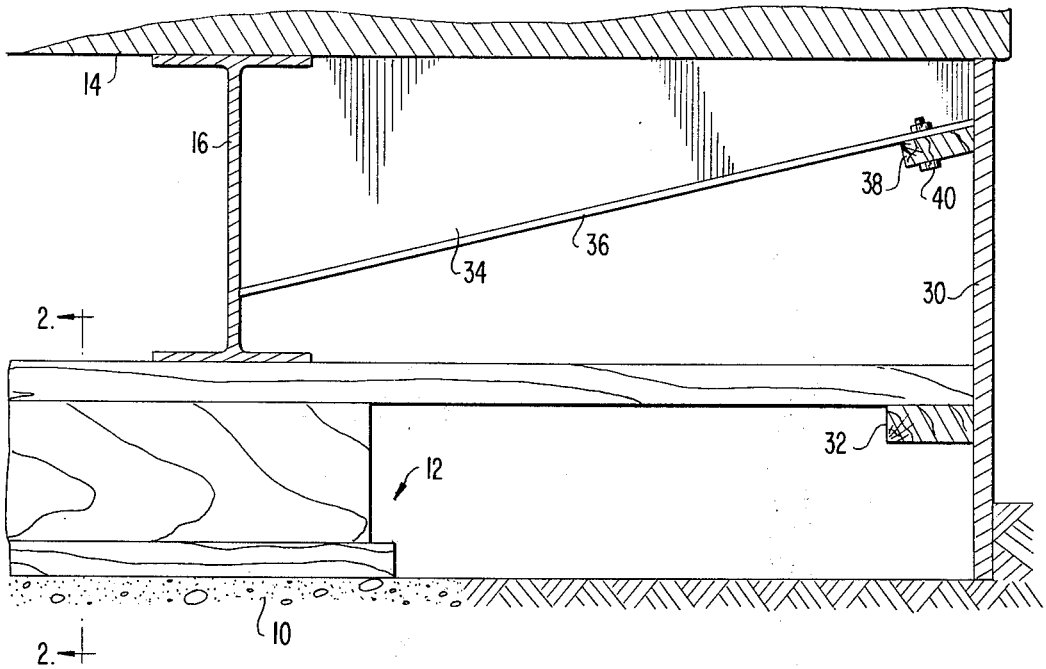
FIG. 2
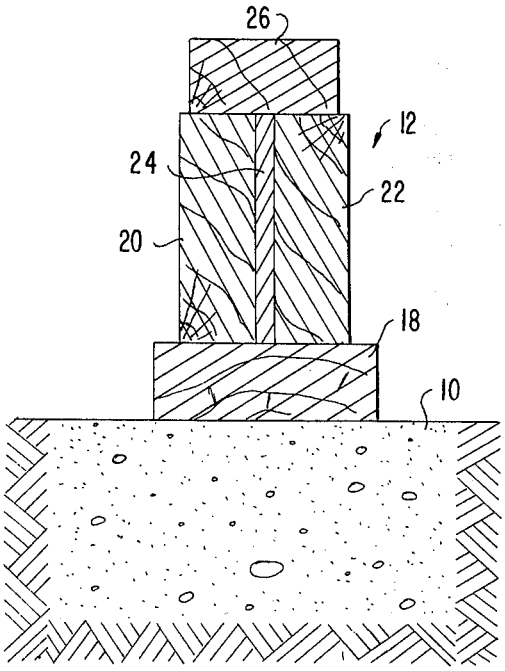
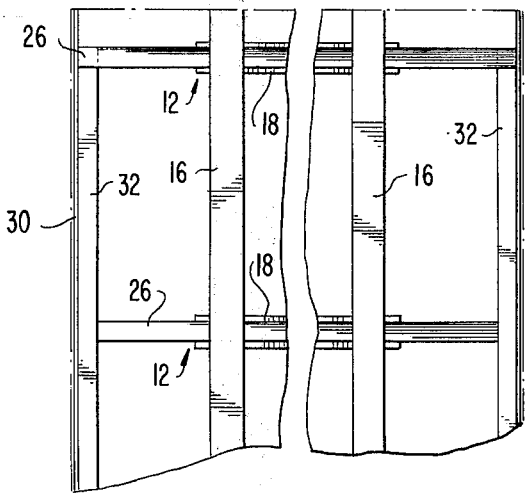
FIG. 3

MOBILE HOME FOUNDATION

BACKGROUND OF THE INVENTION

1. Field of the Invention

The present invention is directed to mobile home foundations and more specifically to an all wood support beam and decorative skirt assembly for mobile homes.

2. Prior Art

When mobile homes are located at a semipermanent installation it is desirable to support the mobile home on some type of foundation so that the wheels can be removed completely or at least disposed in a non-load bearing position. In the past, people have usually resorted to a makeshift supporting arrangement which generally consisted of a stack of cinder blocks which might not even be held together by mortar. More sophisticated arrangements involve the actual pouring of concrete footings, the erection of masonary walls and perhaps even the provision of one or more transverse steel beams for supporting the mobile home. Such arrangements while very effective are also very costly. Furthermore, from an aesthetical point of view many people do not find the provision of a cinder block wall about the base of their trailer pleasing to the eye.

SUMMARY OF THE INVENTION

The present invention provides a mobile home foundation which is suitable for any size home from the small easily trailable house trailers to the more permanent double wide mobile homes which are usually only trailed one from the factory to the building site.

The present invention provides a mobile home foundation which is constructed entirely of treated lumber which is easy and economical to assemble but which will provide a long lasting solid support to which a decorative skirt can readily be attached.

The present invention provides a mobile home foundation which is comprised of a plurality of composite wood beams mounted on a wood support plate which in turn is directly mounted on a gravel support bed. The beams are adapted to extend transversely of the longitudinal axis of the mobile home and the top plate of each beam extends to the lateral edge of the mobile home. Longitudinal nailing strips interconnect the ends of the top plates and a decorative wooden siding of treated lumber is secured thereto.

The foregoing and other objects, features and advantages of the invention will be apparent from the following more particular description of a preferred embodiment of the invention as illustrated in the accompanying drawings.

BRIEF DESCRIPTION OF THE DRAWINGS

FIG. 1 is a partial transverse sectional view of a mobile home and skirt mounted on a support beam according to the present invention.

FIG. 2 is a sectional view of the support beam taken along the line 2—2 of FIG. 1.

FIG. 3 is a partial top plan view of the mobile home foundation according to the present invention with the main body portion of the mobile home removed from the I-beams for the sake of clarity.

DETAILED DESCRIPTION OF THE PREFERRED EMBODIMENTS

The mobile home foundation according to the present invention can be directly mounted on a gravel bed 10 or any other suitably prepared surface such as concrete, asphalt, or even directly on the dirt. However, the gravel support bed 10 has proved most effective since it allows the moisture to drain away from the wood foundation of the present invention.

The mobile home foundation according to the present invention is comprised of at least two composite wood beams 12 which extend transversely of the longitudinal axis of the mobile home 14. The number of beams utilized will depend upon the length and weight of the mobile home unit and the spacing between the beams will be determined accordingly. Most mobile homes are provided with some form of longitudinal support beam such as the I-beam 16 shown in FIG. 1 of the present application. In fact the majority of the homes would utilize a pair of parallel longitudinal support beams such as those shown in FIG. 3. The support beams according to the present invention would extend transversely of these longitudinal structural beams 16 which would rest directly on the support beams 12 according to the present invention.

These support beams 12 are constructed entirely of wood and rest on a wood footing plate 18 such as a 2 × 6 inch plank. The beam itself is constructed of two 2 × 6 inch planks secured together with a half-inch plywood spacer 24 disposed therebetween. The elements of the beam may be secured together by nailing, bolting, adhesives or combinations of these fastenings means. The length of the beam should be long enough to span the distance between the two steel support beams 16 of the mobile home but do not need to extend the entire width of the mobile home. The beam 12 is provided with a 2 × 4 inch top plate 26 nailed to the upper surface thereof and extending laterally from each end of the beam 12 to the edge of the mobile home. The top plate could initially be of a relatively long standard length which could be cut to the proper length after installation of the mobile home 14 on the support beams 12.

A decorative skirt 30 of half-inch pressure treated plywood can be secured along the sides of the mobile home between the bottom of the mobile home and the ground to improve the appearance and to additionally provide a dead air space for insulating purposes. A 2 × 4 inch nailing strip 32 is secured to the ends of the top plates 26 by nails, bolts, adhesives or any combination thereof to which the skirt 30 can be nailed. Most mobile home manufacturers provide some type of wooden nailing strip along the lower edge of the mobile home body for the purposes of securing a skirt. In the embodiment shown in FIG. 1 the mobile home is provided with a steel reinforcing web 34 which extends outwardly from the I-beam 16 to a point spaced inwardly from the edge of the mobile home body 14. The web 34 is provided with a flange 36. Several of these webs would be spaced along the length of the mobile home and a nailing strip 38 could be secured to the outermost edge of these webs by bolts 40 or the like which could extend through suitably drilled holes in the flange 36. Thus, the upper edge of the skirt 30 could be nailed to the nailing strip 38 to provide a rigid support for the skirt. Since the skirt 30 is of pressure treated lumber it can extend all the way to the ground and in fact the earth can be built up on the outside surface of the skirt to completely hide the lower edge of the skirt.

In order to provide a skirt for the ends of the mobile home the nailing strips 38 and 32 could be extended beyond the support beams to the end of the mobile home and a transverse nailing strip (not shown) could be secured thereto to extend across the width of the mobile home. A skirt similar to the skirt 30 could then be nailed to the transverse nailing strips to completely enclose the space beneath the mobile home 14.

When the invention has been particularly shown and described with reference to a preferred embodiment thereof it will be understood by those in the art that various changes in form and details may be made therein without departing from the spirit and scope of the invention.

What is claimed is:

1. A mobile home foundation adapted to be mounted directly on a gravel support bed comprising at least one wood plank adapted to rest on the gravel bed and extend transversely of the longitudinal axis of the mobile home, a wood beam secured to the upper surface of said plank, a wood top plate secured to the top of the beam and extending into close proximity to the sides of the mobile home, nailing strips secured to the ends of said plate perpendicular thereto and skirt means for the mobile home secured to said nailing strips.

2. A mobile home foundation as set forth in claim 1 further comprising an additional plank, beam and plate assembly disposed parallel to the first mentioned plank, beam and plate, said nailing strips extending between and secured to both plates for supporting said skirt means.

3. A mobile home foundation as set forth in claim 1 wherein all of said wood is pressure treated with preservatives to resist moisture and insects.

4. A mobile home foundation as set forth in claim 2 further comprising additional wood nailing strips disposed parallel to said first mentioned nailing strips adapted to be secured to the underside of said mobile home parallel to and adjacent the side edges of said mobile home and means for securing said skirt means to said additional nailing strips.

5. A mobile home foundation as set forth in claim 1 wherein said beam is a composite beam comprised of two boards each having a cross-section identical to said plank mounted edgewise on said plank and a spacer secured between said boards to provide a beam width equal to the width of said top plate.

* * * * *